United States Patent [19]

Mazzoni, Jr.

[11] 3,960,302

[45] June 1, 1976

[54] SKI CARRYING STRAP

[76] Inventor: Albert H. Mazzoni, Jr., 3910 Mission St., San Francisco, Calif. 94112

[22] Filed: Nov. 25, 1974

[21] Appl. No.: 527,102

Related U.S. Application Data

[63] Continuation-in-part of Ser. No. 384,560, Aug. 1, 1973, abandoned.

[52] U.S. Cl. ..... 224/45 S; 224/58

[51] Int. Cl.[2] ..... B65D 71/00

[58] Field of Search ..... 224/45 S, 45.9, 49, 224/55, 1 A, 5.26, 58; 24/30.5, 204, 74 R; 280/37.11 SK, 37.11 R

[56] References Cited

UNITED STATES PATENTS

| | | | |
|---|---|---|---|
| 3,278,097 | 10/1966 | Duckworth | 224/55 |
| 3,319,852 | 5/1967 | Perkins | 224/1 R |
| 3,768,711 | 10/1973 | Wilkinson | 224/45 S |

*Primary Examiner*—Robert J. Spar
*Assistant Examiner*—Kenneth Noland
*Attorney, Agent, or Firm*—Townsend and Townsend

[57] ABSTRACT

A strap adapted to be loosely tied at either end to a pair of skis to facilitate carrying of the skis. Spaced strips of mutually engageable fastening material are attached to the strap adjacent both ends thereof, and can be engaged to inhibit untying of the loosely tied ends of the strap. The fastening material has end flaps which prevent the tension in the straps from disengaging the engaged material. Fore and aft loops are provided in the strap to hold the ski poles.

4 Claims, 3 Drawing Figures

SKI CARRYING STRAP

CROSS-REFERENCE TO RELATED APPLICATION

This is a continuation-in-part of my application Ser. No. 384,560 filed Aug. 1, 1973 now abandoned for SKI CARRYING STRAP.

BACKGROUND OF THE INVENTION

The present invention relates to ski carrying apparatus, and particularly to means for hand carrying skis and poles to and from a skiing area.

One of the annoyances which detract from the enjoyment of the sport of skiing is the difficulty of carrying the equipment required, namely, a pair of skis, a pair of ski poles, a pair of ski boots, and extra sweaters and the like, from the parking lot to the ski area. As the popularity of skiing increases, this walk becomes more and more lengthy, and is a particular annoyance to women and children.

Skis and poles are awkward items to carry by hand, and many attempts have been made to provide a simple means for binding the items together so that they can be more easily carried. Examples of such devices are illustrated in U.S. Pat. No. 3,486,672, U.S. Pat. No. 3,342,388, and U.S. Pat. No. 2,530,695. However, none of the devices presently available have achieved wide usage although the need for such a device is well known.

The reasons why currently available ski and pole carrying apparatus are not generally used are apparently two-fold. The first reason is that the devices are difficult and time consuming to properly attach to the skis and poles, and they therefore cause more problems than they solve. Such devices employ buckles and like fastening means which are difficult to handle, particularly in cold temperatures when the skier is wearing heavy gloves. Furthermore, the baskets on the poles often interfere with the operation of the device. The second reason is that such prior art devices are bulky and have sharp metal components, so that they cannot be safely and conveniently stored in the skier's pocket while he is skiing. Since the purpose of the apparatus is to carry skis and poles to and from the slopes, it is essential that the apparatus be stored on the skier's person while he is skiing.

SUMMARY OF THE INVENTION

The present invention provides a nylon strap which can be either hand held or placed over the shoulder of the carrier. The ends of the strap are loosely tied to the fore and aft portions of the skis. Spaced strips of mutually engageable fastening material are attached to each end of the strap and engaged after the knots are tied to inhibit untying of the loosely tied ends of the strap.

With the present invention, the skier is not required to fasten a buckle or tie a complete knot, which can be quite difficult with gloved hands, or cold ungloved hands. The knot required in the present invention is a simple loop knot and remains tied by the engagement of the fastening material. The strap is readily attached to the skis by tying a loop knot and engaging the fastening material even while the skier has his gloves on and it provides a secure ski carrier.

The strap is preferably made of nylon. It can be crumpled together and placed in the skier's pocket while he is skiing. Since no buckles are used, there is no safety hazard to the skier. When the skier is finished for the day, he can take the strap out of his pocket and attach it to the skis as discussed above.

The invention provides loops in the fore and aft portions of the strap to hold the ski poles. The loops are comprised of nearly equal lengths of strap material so that the sides of the loops are biased together when the strap is tensioned. The ski poles are inserted through the loops while the strap is limp. When the skis are carried, strap tension biases the loop closed and thereby securely retains the poles. The loops are sufficiently spaced from the strap ends so that the baskets of the poles are clear of the skis and cannot be bent or otherwise damaged.

If the strips of fastening material are completely fastened to the strap, the tension on the strap has a tendency to loosen the connection formed by the strips. Apparently, the tension pulls the strips apart so that they exhibit little shear strength. By leaving a section of the lower part of the fastening material loose, that is by not securing such section to the straps, the above discussed danger of weakening the holding force of the fastening material is substantially reduced or eliminated.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
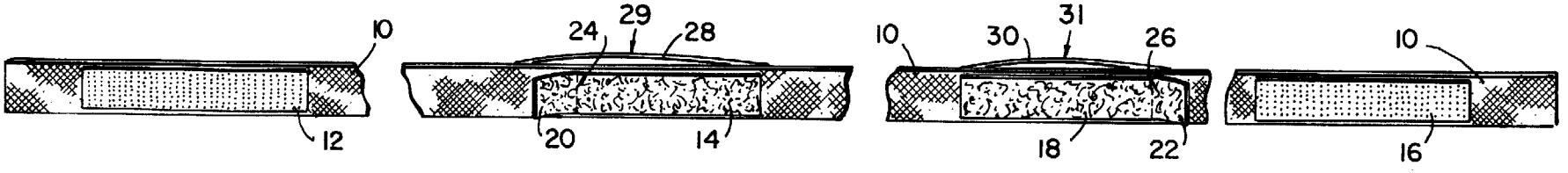
FIG. 1 is a perspective view of the face of the strap having the fastening material thereon, with various portions of the strap broken away.

The mutually engageable fastening material on the ends of the strap 10 is illustrated by way of reference to FIG. 1. Velcro, which consists of hook and eye sections, is preferably used as the fastening material, but similar types of engageable material such as conventional snaps could be used as well. A strip of hook material 12 is sewn to the strap 10 adjacent one end, and a strip of eye material 14, also sewn to the strap, is spaced somewhat from the hook material 12. Strips of hook material 16 and eye material 18 are similarly disposed at the opposite end of the strap 10. In the embodiment of FIG. 1, the hook material 12 and 16 is illustrated at the end of the strap with the eye material 14 and 18 spaced from the ends of the strap, but this arrangement is not required. Also, it is not necessary that the strips of hook and eye material 12 and 14 on one end of strap 10 be on the same face of the strap as the other strips of hook and eye material 16 and 18.

Referring still to FIG. 1, the srips of eye material 14 and 18 have loose flap sections 20 and 22 on the ends of the eye material adjacent the end of strap 10. The loose flap sections 20 and 22 are formed by sewing the eye material 14 and 18 to the strap 10 at a point spaced from the end of the eye material, as illustrated by seams 24 and 26.

Short sections of material 28 and 30, preferably of the same material as the strap itself, are attached to the strap 10, opposite the inner strips of fastening material 14 and 18. The sections of strap material 28 and 30 are nearly the same length as the included sections of the strap and define loops 29 and 31 for receiving ski poles. When the weight of the skis exerts tension in the strap 10, the sides of the loops will be biased together and the ski poles will be held in the loops.

Figure 2:
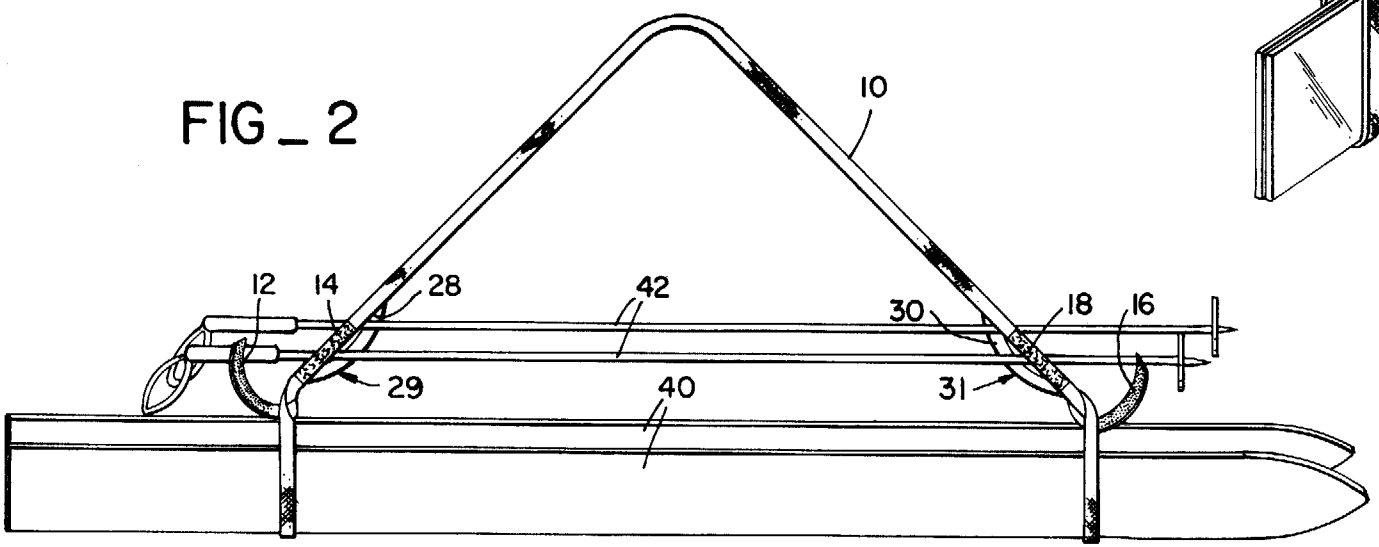
FIG. 2 is a perspective view of the skis and poles held by the strap, with the fastening material about to be engaged.

Referring next to FIG. 2, a pair of skis 40 and a pair of ski poles 42 are illustrated attached to the strap 10. The ends of the strap 10 are loosely tied around the skis 40 as illustrated. The loose knot can be easily tied by a skier, even while wearing ski gloves or mittens, but the loose knot itself would not be sufficient to securely fasten the skis to the strap. Hence, the corresponding strips of fastening material are attached to the strap at either end thereof, and can be engaged on either side of the respective tied portions of the strap to prevent the knots from untying. In this manner, the skis 40 are securely connected to the strap 10 by the combination of the loose knot and the fastening material, avoiding the necessity of a complex fastening device. When the skis 40 are to be removed from the strap 10, the strips of fastening material can be easily disengaged, even while the skier is wearing gloves or mittens, and the knots untied.

Still referring to FIG. 2, the ski poles 42 are illustrated passing through the loops 29, 31 formed by the sections of strap material 28 and 30. When the skis 40 are being carried, tension in the strap 10 will compress the ski poles 42 between the strap and the sections 28 and 30 of strap material to prevent the ski poles from sliding through the loops.

Figure 3:
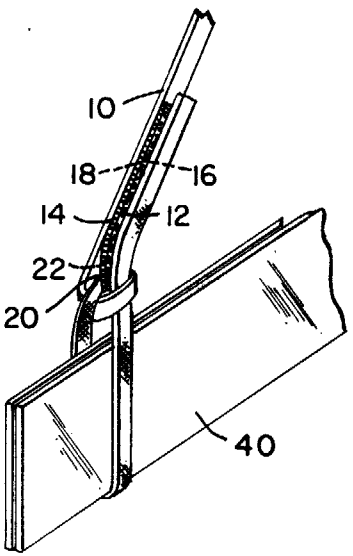
FIG. 3 is a fragmentary view of a loose loop knot in one end of the strap enclosing the skis, illustrating the engaged fastening material.

A fragmentary view of one end of the ski strap 10 knotted around the skis 40 is illustrated by way of reference to FIG. 3. It is apparent from the figure that when the skis 40 are carried by the strap, tension in the strap will tend to pull the engaged strips of fastening material 12 and 14 (or 16 and 18) apart. If both strips of fastening material were completely sewn to the strap 10, the action of pulling the strips of fastening material apart would easily disengage the material closest to the knot, then progressively disengage the rest of the material. In time, the strips of fastening material would come apart and the loosely tied knot would become undone. However, by providing a loose end flap 20 (or 22) at the lower end of the spaced strip of fastening material 14 (or 18), the tension in the strap 10 pulls the corresponding strip of fastening material apart longitudinally and the material will not readily disengage.

While a preferred embodiment of the present invention has been illustrated above, it is apparent that modifications and adaptations of that embodiment will occur to those skilled in the art. For example, various ways of rearranging the strips of fastening material may be devised. However, it is to be expressly understood that such modifications and adaptations of the above embodiment are within the spirit and scope of the present invention, as set forth in the following claims.

I claim:

1. Apparatus for hand-carrying a pair of skis and ski poles comprising a strap adapted to be placed over the shoulder of the carrier, a first end of said strap adapted to be loosely tied to the forward portion of the skis to form a first tied portion, the second end of said strap adapted to be loosely tied to the rearward portion of the skis to form a second tied portion; spaced strips of mutually engageable fastening material attached to the strap adjacent the first end thereof on opposite sides of the first tied portion and engageable to inhibit untying of the first end of the strap, at least one of said spaced strips of fastening material adjacent the first end of the strap having a loose flap section unattached to the strap; and spaced strips of mutually engageable fastening material attached to the strap adjacent the second end thereof on opposite sides of the second tied portion and engageable to inhibit untying of the second end of said strap, at least one of said spaced strips of fastening material attached to the strap adjacent the second end having a loose flap section unattached to the strap, whereby disengagement of the corresponding strips of fastening material due to tension in the strap is inhibited.

2. Apparatus as in claim 1 and additionally comprising fore and aft loops in the strap for insertion of the ski poles therethrough, each said loop comprising a short section of strap material attached at both ends to the strap, said sections and the included strap portions being of nearly equal length so that tension in the strap biases the sides of the loops together to hold the ski poles therein.

3. Apparatus for transporting gear to and from a ski slope, said apparatus comprising:

a pair of skis;

a strap having opposite ends loosely tied fore and aft to said pair of skis to form tied portions adjacent the opposite ends of the strap;

paired strips of mutually engageable hook and eye material adjacent each end of the strap on opposite sides of the respective tied portions and engaged to inhibit untying of the ends of the strap, one strip of each pair of strips substantially at the ends of the strap and the other strip of each pair of strips spaced from the ends of said strap, each said spaced strip having a loose flap on the ends of the strip nearest the ends of the strap, whereby disengagement of the engaged hook and eye strips by tension in the strap is inhibited.

4. Apparatus as in claim 3 and additionally comprising a pair of ski poles, and fore and aft loops in the strap having the ski poles inserted therethrough, said loops comprising nearly equal length sections of strap material joined at the ends thereof to the strap, whereby tension in the strap acts to compress the ski poles between the strap sections to prevent accidental slippage of the ski poles through the loops.

* * * * *